US005423674A

United States Patent [19]

Knöpfel et al.

[11] Patent Number: 5,423,674

[45] Date of Patent: Jun. 13, 1995

[54] FIRING INSTALLATION

[75] Inventors: Hans P. Knöpfel, Besenbüren; Hans Peter, Urdorf; Claude Pelet, Lonay, all of Switzerland

[73] Assignee: ABB Research Ltd., Zurich, Switzerland

[21] Appl. No.: 253,158

[22] Filed: Jun. 2, 1994

[30] Foreign Application Priority Data

Jun. 18, 1993 [DE] Germany ..... 43 20 212.8

[51] Int. Cl.[6] ..... F24C 5/00

[52] U.S. Cl. ..... 431/9; 431/115; 431/351; 431/352

[58] Field of Search ..... 431/10, 9, 8, 4, 115, 431/116, 350, 351, 353, 217, 215; 110/264, 347

[56] References Cited

U.S. PATENT DOCUMENTS 5,127,821 7/1992 Keller ..... 431/351
5,147,200 9/1992 Knopfel et al. ..... 431/115

FOREIGN PATENT DOCUMENTS

0394800A1 10/1990 European Pat. Off. .
0436113A1 7/1991 European Pat. Off. .
0483520A2 5/1992 European Pat. Off. .
8909288.0 1/1990 Germany .
1486684 9/1977 United Kingdom .

*Primary Examiner*—James C. Yeung
*Attorney, Agent, or Firm*—Burns, Doane, Swecker & Mathis

[57] ABSTRACT

A firing installation includes a combustion space fed by premixing burners having combustion air inlet slots along the length of the burner bodies that create a tangentially directed inflow of combustion air. Fresh air guides are positioned along the inlet slots upstream to guide fresh air into the slots, and include an end plate having a plurality of perforations that act as air injection nozzles. Movement of fresh air through the nozzles creates a vacuum that draws combustion air from the combustion space into the inlet slots where it mixes with the fresh air to form a combustion gas mixture.

9 Claims, 3 Drawing Sheets

FIRING INSTALLATION

BACKGROUND OF THE INVENTION

1. Field of the Invention

The present invention relates to a firing installation. It also relates to a method for operating such an installation.

2. Discussion of Background

In accordance with the pure air regulations, it is necessary to ensure—when operating a firing installation—that the pollutants occurring as a result of tile combustion do not exceed the maximum permitted emission figures. This applies not only during correct operation under load but also during the whole of the starting phase. For this purpose, it has become known to mix a proportion of combustion gases with the fresh air, i.e. to operate combustion gas recirculation. In order to ensure that ignition of the mixture occurs, particularly during the starting phase, it is necessary to keep the recirculation rate as small as possible. The recirculation rate can be appropriately increased later. The recirculation rate necessary can be set by appropriate measures. A low combustion gas recirculation rate, however, never produces the minimum possible pollutant emission figures. Faulty admixture of the recirculating gas and fresh air is also detrimental to pollutant emissions. On the other hand, the problem cannot be avoided by deliberately operating with a higher recirculation rate because, during transient operation, this would inevitably introduce the danger that ignition and flame stability could be impaired.

A firing installation known from U.S. Pat. No. 5,147,200 to Knopfel et al. includes a fan which acts outside the envelope of the firing installation and which induces fresh air and mixes it with a certain proportion of combustion gases induced from the combustion space. The resulting fresh air/combustion gas mixture passes through a first heat exchanger on its way to the combustion space, the thermal preparation of this heat exchanger being provided by the combustion gases supplied. In the combustion space itself, this mixture flows through a heat exchanger which is positioned there. Before this mixture is supplied to a burner as combustion air, it experiences a further admixture of combustion gases by means of a main jet injector. This combustion gas admixture technique assumes a relatively long further mixture-formation distance upstream of the inlet into the internal space of the burner. In addition, inducing combustion gases centrally, as is done in this method, can always lead to form instability.

SUMMARY OF THE INVENTION

Accordingly, one object of the invention is to provide help in this respect and, in a firing installation of the type mentioned at the beginning, to control the combustion gas recirculation rate in terms of minimizing the pollutant emissions during the complete operation of the firing installation to maximize the homogeneity of the fresh air/combustion gas mixture with a simultaneous minimizing of the length of the mixture-formation distance.

The essential advantage of the invention may be seen in that the combustion gas recirculation rate is maximized in each phase of the operation of the firing installation, which is responsible for minimizing the pollutant emissions below the legal requirements, without negative effects on the flame.

This can be achieved because the firing installation is configured in such a way and is provided with means to permit passive combustion gas recirculation to be initiated. The firing installation is configured in such a way that the combustion gases automatically come directly into the influence region of the suction effect of the entering fresh air and there combine with the fresh air to form a combustion air mixture. The means for the introduction of the fresh air consists of as large a number as possible of jet injectors. The individual injectors are located outside the actual burner, and induce a quite definite quantity of combustion gas in such a way that the formation of the combustion air from fresh air and combustion gases has an optimum degree of mixing due to its distribution into the largest possible number of partial flows. This unavoidably leads to the fact that the mixing area between the injection area and the induction area can be maximized with the result that the larger these areas are, the greater is the combustion gas recirculation rate. This leads, on the one hand, to better evaporation of the fuel and, on the other, to cooling of the flame.

A further essential advantage of the invention may be seen in the fact that the distribution described above leads to a direct and better mixture formation with a minimized mixture distance, which has a positive effect on the dimensions of the burner.

A further essential advantage of the invention may be seen in the fact that the disposition of the injectors, in terms of their size and location, can be deliberately chosen in order, for example, to meet the final objective of recirculating relatively more part load or, at full load, of having no negative effect on the aerodynamics of the burner.

Advantageous and expedient further developments of the solution to the object of the invention are described below.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
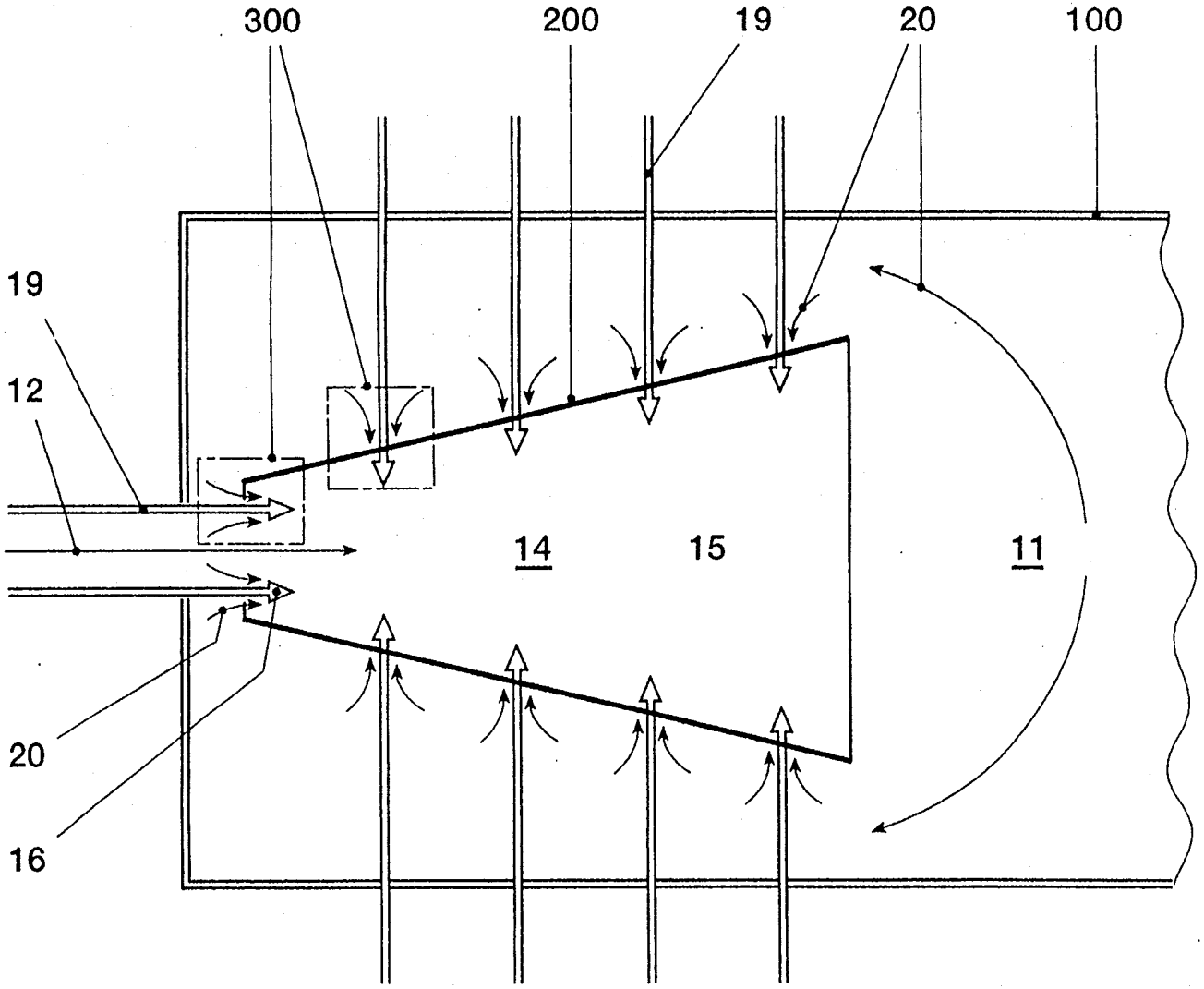
FIG. 1 shows a diagrammatic illustration of a firing installation.

Referring now to the drawings, like reference numerals designate identical or corresponding parts throughout the several views, and all elements not necessary for immediately understanding the invention are omitted and the flow directions of the various media are indicated by arrows. FIG. 1 shows, in a diagrammatic representation, a firing installation 100 which consists essentially of an intrinsically closed combustion space 11 which is in turn equipped with at least one burner 200. The burner 200 shown is a premixing burner whose operation is supplemented by combustion gas recirculation. The combustion airflows 15, 16, which flow into the internal space 14 of the premixing burner 200 and mix there with the fuel 12 which has been introduced (this mixing is considered in more detail further below), consist of fresh air 19 and a proportion of combustion gases 20 which flow back from the combustion space 11. This return flow of the combustion gases 20 is a passive combustion gas recirculation which is initiated by two decisive arrangements. In operation, the premixing burner 200 is fundamentally surrounded by combustion gases 20. In the second place, the premixing burner 200 is equipped with the largest possible number of individual supply means for fresh air 19. The supply means regularly and integrally cover all the openings provided to the internal space 14 of the premixing burner 200. The openings to the internal space 14 are symbolized diagrammatically, both radially and axially, by the arrows 19. It should also be noted that the radial combustion air supply in the premixing burner 200 which can be seen is a tangential flow about which more is stated with respect to FIG. 2 and 3. The individual supplies of fresh air 19 are supplemented throughout by jet injectors 300 which develop the suction force which can initiate a passive combustion gas recirculation, i.e. the combustion gas recirculation rate necessary is set by the suction effect of the entering fresh air 19 without further outside help. The advantages of such a configuration are considered in more detail further below. Reference is made to FIG. 3 with respect to the configuration of the jet injectors.

Figure 2:
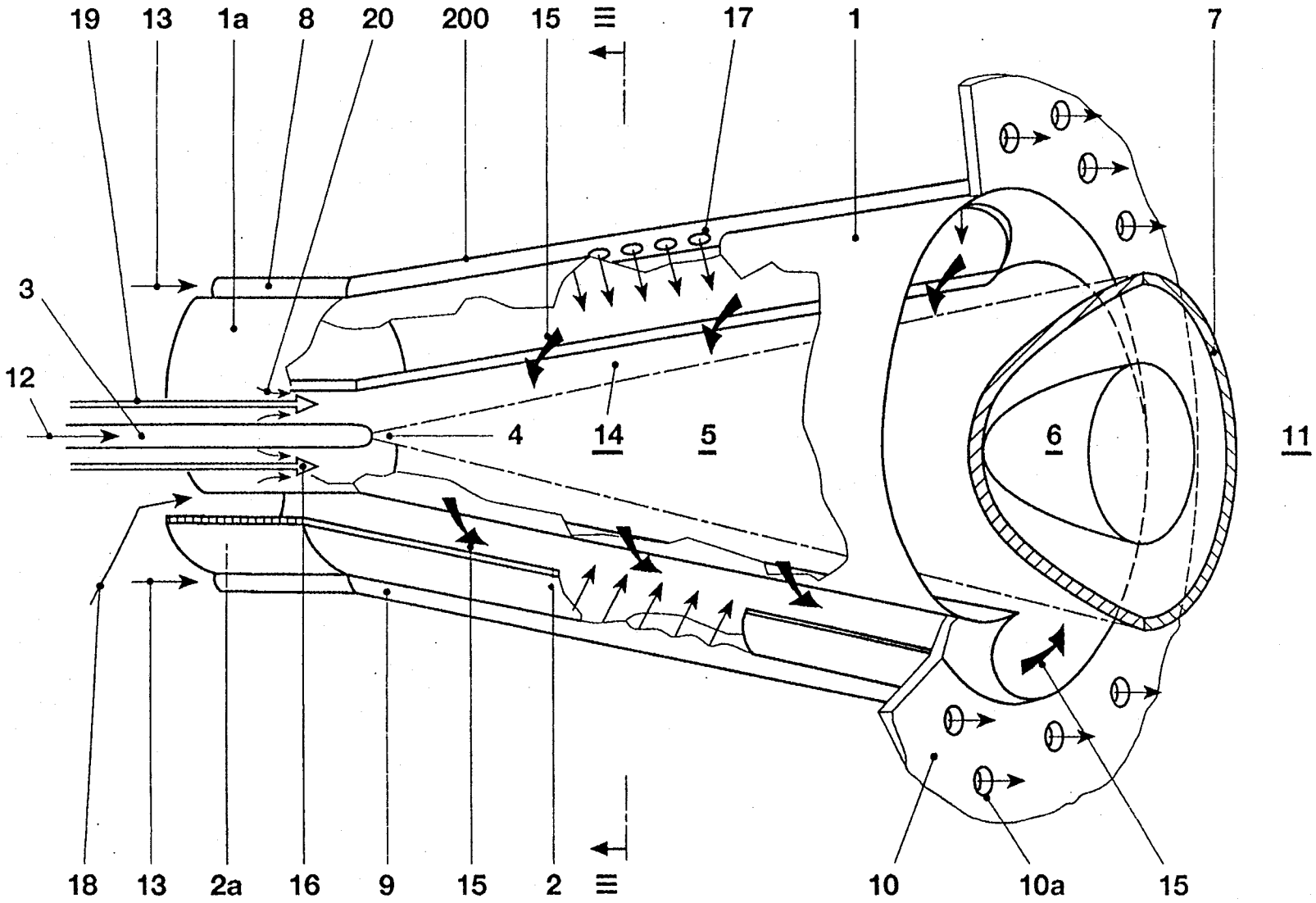
FIG. 2 shows, in a perspective representation appropriately sectioned, a burner for operating the firing installation
Figure 3:
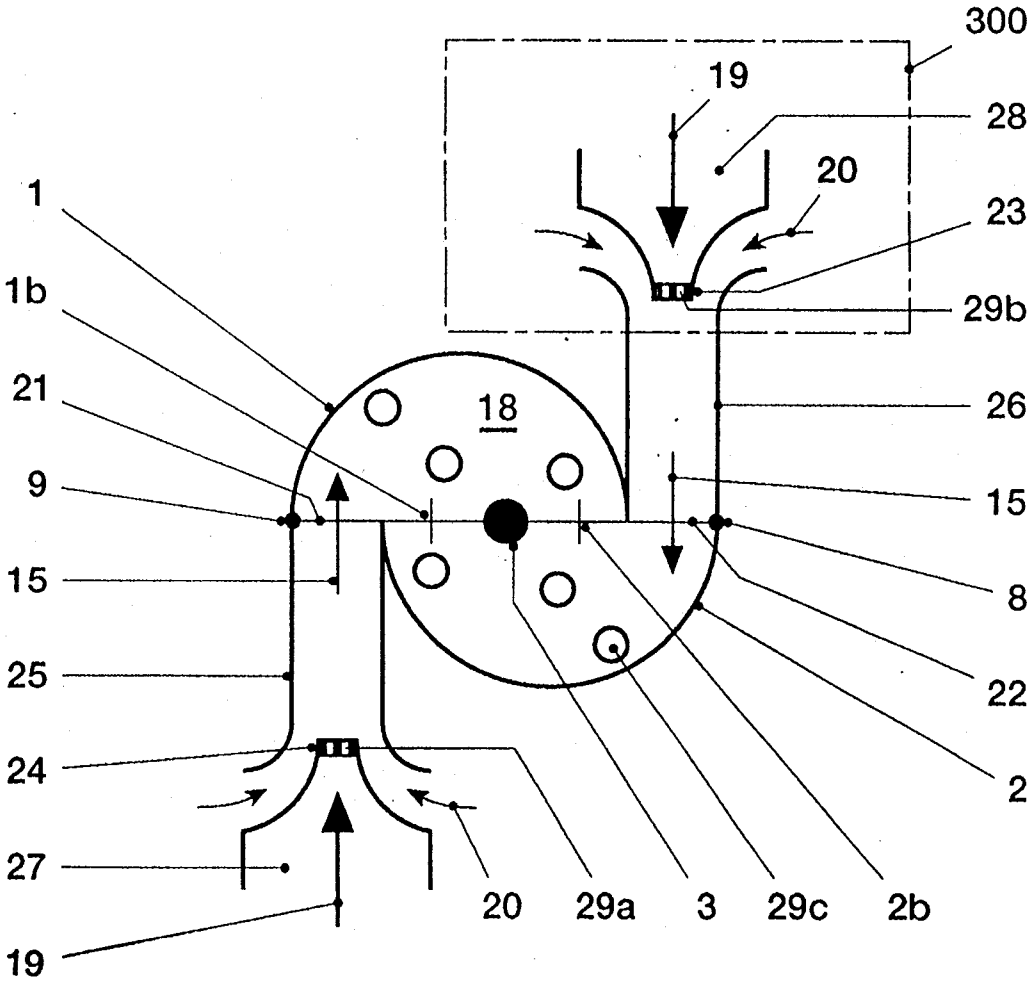
FIG. 3 shows a section through the plane III—III of FIG. 2 in a diagrammatically simplified representation.

FIG. 2 and 3 should be consulted simultaneously for better understanding of the construction of the premixing burner 200. Furthermore, in order not to make FIG. 2 unnecessarily difficult to understand, the jet injectors shown in FIG. 3 and the mixing sections extending to the internal space of the premixing burner are not included in the drawing of FIG. 2. The premixing burner 200 of FIG. 2 consists of two hollow partial conical bodies 1, 2 which are offset relative to one another. The number of partial conical bodies necessary for forming the premixing burner 200 is not, of course, limited to two. The conical shape of the partial bodies 1, 2 shown has as a certain fixed angle in the flow direction. The partial bodies 1, 2 can, of course, have a different opening configuration in the flow direction, for example a regularly or irregularly increasing conical inclination, which leads approximately to a trumpet shape in appearance, or a regularly or irregularly decreasing conical inclination which leads approximately to a tulip shape in appearance. The two latter shapes are not included in the drawing because they can be readily imagined. The shape which is finally selected depends on the different parameters of the particular combustion system. The offset between the respective center line 1*b*, 2*b* of the partial conical bodies 1, 2 relative to one another creates a respective longitudinal air inlet slot 21, 22 on both sides in axisymmetrical arrangement (FIG. 3) for a tangential flow of combustion gas into the internal space. In addition, the positioning of bodies 1, 2 provides an axial inlet flow cross-section 18 through which the combustion air 15, 16 consisting of a fresh air/combustion gas mixture flows into the internal space 14 of the premixing burner 200.

Each of the two partial conical bodies 1, 2 has a cylindrical initial part 1*a*, 2*a* which also extend offset relative to one another, in a manner analogous to the partial bodies 1, 2, so that the tangential air inlet slots 21, 22 are present over the complete length of the premixing burner 200. The premixing burner 200 can, of course, have a purely conical configuration, i.e. without the cylindrical initial parts 1*a*, 2*a*. At least one fuel nozzle 3 is accommodated in this cylindrical initial part 1*a*, 2*a*, which is, for example, particularly suitable as a location for anchoring the complete premixing burner 200. In addition, a number of jet injectors are accommodated there and these provide the axially introduced combustion air 16 likewise composed of fresh air and combustion gas.

Reference should be made to FIG. 3 for the configuration of these jet injectors 300. Each of the two partial bodies 1, 2 has, as required, a fuel conduit 8, 9, which extends in the axial direction and which is provided with a number of nozzles 17. A gaseous fuel 13 is preferably supplied through these conduits and this gaseous fuel 13 is added through the said nozzles 17 in the region of the tangential air inlet slots 21, 22 (cf. FIG. 3), to the combustion air 15 flowing through them. The premixing burner 200 can be operated by means of the fuel supply via the nozzle 3 alone or via the nozzles 17 alone. Mixed operation using both nozzles 3, 17 is, of course, possible particularly where different fuels are supplied via the individual nozzles.

At the combustion space 11 end, the premixing burner 200 has a collar-shaped plate 10 which has a number of holes 10*a* through which dilution or cooling air is supplied to the front part of the premixing burner 200. If a liquid fuel 12 is supplied via the nozzle 3, this liquid fuel is sprayed with an acute angle into the internal space 14 of the premixing burner 200 in such a way that a conical spray pattern 5, which is as homogeneous as possible, appears as far as the burner outlet plane.

The fuel injection 4 can involve an air-supported nozzle or a nozzle which operates on the pressure atomization principle. The conical spray pattern 5 is surrounded, corresponding to the number of air inlet slots 21, 22, by tangentially entering combustion airflows 15 and by the axially introduced further combustion air 16.

The concentration of the fuel 12 introduced is continually reduced in the flow direction of the premixing burner 200 by the combustion airflows 15, 16 already mentioned. If a gaseous fuel 13 is introduced, the formation of the mixture with the combustion air 15 has already commenced in the region of the air inlet slots 21, 22. When a liquid fuel 12 is used, the optimum, homogeneous fuel concentration of the cross-section is achieved in the region of the vortex breakdown, i.e. in the region of the reverse flow zone 6 at the end of the premixing burner 200.

The ignition of the fuel/combustion air mixture commences at the apex of the reverse flow zone 6. It is only at this location that a stable flame front 7 can develop. In this case, there is no danger of a flash-back of the flame into the inside of the premixing burner 200—as must always be feared in the case of known premixing distances and against which aid is sought by means of complicated flame holders.

If, however, the combustion air 15, 16 is preheated, an accelerated and complete evaporation of the liquid fuel 12 takes place before the point is reached, at the outlet from the premixing burner 200, at which the ignition of the mixture can take place.

The possibility of combustion gas recirculation, which not only includes a thermal component, has already been considered in more detail with respect to FIG. 1. The degree of evaporation depends on the size of the premixing burner 200, the droplet size of the fuel 12 and the temperature of the combustion airflows 15, 16. Minimizing the pollutant emissions depends basically on the combustion gas recirculation, which has the effect that complete evaporation of the fuel can take place before entry into the combustion zone.

Close limits have to be maintained with respect to the design of the partial conical bodies 1, 2 in terms of the conical inclination and the width of the tangential air inlet slots 21, 22 if, for flame stabilization purposes, the desired flow field of the combustion air, with its reverse flow zone 6 in the region of the opening of the premixing burner 200, is to occur. In general, it may be stated that a reduction of the air inlet slots 21, 22 displaces the reverse flow zone 6 further upstream so that the mixture then ignites earlier. It should, however, be stated at this point that the reverse flow zone 6, once fixed in location, is intrinsically stable in position because the swirl number increases in the flow direction in the region of the conical shape of the premixing burner 200.

The axial velocity of the mixture can, furthermore, be influenced by the axial supply of combustion air 16, already mentioned. If a specified design length of the premixing burner 200, is not to be exceeded, the construction of the premixing burner 200 is extremely suitable for altering the gap width of the tangential air inlet slots 21, 22 because the partial conical bodies 1, 2 can be displaced towards or away from one another so that the resulting distance between the two center lines 1*b*, 2*b* is reduced or increased as may be easily deduced from FIG. 3.

It is also immediately possible to displace the partial conical bodies 1, 2 into one another by a rotary motion. This makes it possible, given an appropriate arrangement, to vary the shape and size of the tangential air inlet slots 21, 22 during operation so that the same premixing burner 200 can cover a wide range of functions without changing the design length.

FIG. 3 is a section approximately at the center of the premixing burner 200, in accordance with the section plane III—III of FIG. 2. The symmetrical, tangentially arranged inlet ducts 25, 26 fulfil the function of a mixing length in which the final mixture formation between the fresh air 19 and the recirculated combustion gas 20 is perfected. The combustion air 15 is prepared in a jet injector system 300; the axially introduced air is likewise prepared in a jet system.

Upstream of each inlet duct 25, 26, which acts as the tangential inlet flow into the internal space of the premixing burner 200, the fresh air 19 is distributed evenly by means of an axial gutter or guide 27, 28 along the complete length of this premixing burner, as is symbolized in FIG. 1 by the number of arrows. In the flow direction towards the tangential inlet slots 21, 22, this gutter 27, 28 is terminated by a perforated plate 23, 24. The perforations fulfil the function of individual injector nozzles 29*a*, 29*b*, which exert a suction effect relative to the surrounding combustion gas 20 in such a way that each injector nozzle 29*a*, 29*b* respectively induces only a certain proportion of the combustion gas 20 so that a uniform combustion gas admixture takes place over the complete axial length of the perforated plate 27, 28.

This configuration has the effect that at the contact location of the fresh air 19 and the combustion gas 20, there is already thorough mixing so that the flow length of the inlet ducts 25, 26 for the mixture formation can be minimized. In addition, the present jet injector configuration 300 is characterized by the fact that the geometry of the pre-mixing burner 200, in particular with respect to the shape and size of the tangential air inlet slots 21, 22, remains stable in form, i.e. no heat-induced distortions occur along the complete axial length of the premixing burner 200 due to the evenly metered distribution of the intrinsically hot combustion gases 20.

The same jet injector configuration as that just described here also applies to the axial formation of the fresh air/combustion gas mixture. The inlet flow cross-section 18 is, in this case, likewise covered by a number of injector nozzles 29*c* which function on the same principle as the injector nozzles 29*a*, 29*b*—as is also symbolically apparent from FIG. 1. In consequence, all the inlet flow openings of the fresh air 19 before the formation of its mixture with the combustion gas 20 are provided, in the flow direction towards the internal space of the premixing burner 200, with a tight network of injector nozzles 29*a*, 29*b*, 29*c* which determine the degree of fresh air/combustion gas mixture.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A firing installation, comprising:

a premixing burner comprising at least two hollow bodies shaped as generally conical sections, mounted in a combustion space and positioned to form an interior space having a base end and an outlet end with oppositely located longitudinal inlet slots for a tangential flow of combustion gas into the interior space;

at least one fuel nozzle positioned to inject a fuel into the interior space; and an air guide disposed upstream of each of the inlet slots and extending the longitudinal length of the inlet slot, each air guide including a plate having a plurality of perforations to inject jets of air into the slots, wherein air flowing as jets induces a flow of combustion gas directly from the combustion space to flow into the inlet slots and mix with the flowing air.

2. The firing installation as claimed in claim 1, wherein the at least one fuel nozzle is mounted at an apex of the conical interior space to inject fuel axially into the burner.

3. The firing installation as claimed in claim 2, further comprising means for introducing a liquid fuel through the axially directed fuel nozzle.

4. The firing installation as claimed in claim 1, wherein the hollow bodies have a uniformly increasing flow cross-section in a direction from the base end to the outlet end.

5. The firing installation as claimed in claim 1, wherein the hollow bodies have a non-uniformly increasing flow cross-section in a direction from the base end to the outlet end.

6. The firing installation as claimed in claim 1, wherein the hollow bodies have a decreasing flow cross-section in a direction from the base end to the outlet end.

7. The firing installation as claimed in claim 1, further comprising a plurality of fuel nozzles disposed along each of the longitudinal inlet slots to inject fuel into the inlet slots.

8. The firing installation as claimed in claim 7, further comprising means for introducing a gaseous fuel through the plurality of fuel nozzles disposed along the inlet slots.

9. A method of operating a firing installation having a premixing burner comprising at least two hollow bodies shaped as generally conical sections, mounted in a combustion space and positioned to form an interior space with oppositely located longitudinal inlet slots for a tangential flow of combustion gas into the interior space, at least one fuel nozzle positioned to inject a fuel into the interior space, and an air guide disposed upstream of each of the inlet slots and extending the longitudinal length of the inlet slot, each guide including a plate having a plurality of perforations to inject jets of air into the slots, the method comprising the steps of:

injecting fresh air into the inlet slots through the perforated plate; and allowing combustion air to be drawn from a combustion space by a vacuum created by the fresh air injection and mixed with the fresh air in the inlet slots;

wherein air flowing through each perforation draws a predetermined amount of combustion air into the slot.

* * * * *